United States Patent [19]

Lewis

[11] 4,159,938

[45] Jul. 3, 1979

[54] START-UP PROCEDURE FOR REFORMING WITH PLATINUM-IRIDIUM CATALYSTS

[75] Inventor: William B. Lewis, Baton Rouge, La.

[73] Assignee: Exxon Research & Engineering Co., Florham Park, N.J.

[21] Appl. No.: 863,865

[22] Filed: Dec. 23, 1977

[51] Int. Cl.[2] ..... C10G 35/08

[52] U.S. Cl. ..... 208/139; 208/140; 252/415

[58] Field of Search ..... 208/139, 140; 252/415

[56] References Cited

U.S. PATENT DOCUMENTS

| | | | |
|---|---|---|---|
| 3,897,328 | 7/1975 | Mitchell | 208/139 |
| 3,936,369 | 2/1976 | Hayes | 208/139 |
| 3,941,682 | 3/1976 | Kmack | 208/140 |
| 3,956,107 | 5/1976 | Mitchell | 208/139 |
| 3,998,755 | 12/1976 | Hayes | 208/140 |
| 4,018,670 | 4/1977 | Sinfelt et al. | 208/139 |
| 4,046,673 | 9/1977 | Paynter et al. | 208/140 |

*Primary Examiner*—C. Davis

*Attorney, Agent, or Firm*—L. A. Proctor

[57] ABSTRACT

A process wherein a bed of catalyst comprised of platinum and iridium is contacted and pretreated at elevated temperature in a zone, prior to the introduction and contact of the catalyst with feed, with hydrogen, water, halogen, suitably chlorine or hydrogen chloride, or both, and hydrogen sulfide. The bed of catalyst is treated up to, but not significantly beyond the point of breakthrough of hydrogen sulfide from the bed. In its preferred aspects, a bed of fresh or regenerated, reactivated catalyst is wetted with water and an admixture of hydrogen and halogen, preferably hydrogen chloride, saturated or near-saturated with water, is passed through the catalyst bed until the time that the bed has adsorbed, absorbed or has otherwise taken up these components, and they begin to appear in the exit gas. On breakthrough of the hydrogen chloride, the introduction of the hydrogen sulfide gas is continued to breakthrough from the exit side of the bed. Thereafter, feed is introduced at reforming conditions to initiate the reforming operation.

18 Claims, No Drawings

START-UP PROCEDURE FOR REFORMING WITH PLATINUM-IRIDIUM CATALYSTS

FIELD OF THE INVENTION

This invention relates to a process for start-up of a catalytic reforming unit, or process for pretreating or preconditioning a fresh or coke-depleted reforming catalyst prior to the time that the reforming unit which contains the catalyst is put-on-stream.

Catalytic reforming, or hydroforming, is a well known and long commercially established process wherein low octane hydrocarbon fractions boiling in the gasoline range are converted at high yield, into aromatic-rich reformates, or product stocks which have a substantially higher concentration of aromatics with consequently higher octane numbers. Typically, in a multiple reactor reforming unit, each reactor is provided with an upstream heater, the reactors are employed in series, and each is charged with a fixed bed of fresh or regenerated, reactivated catalyst. Suitably, prior to putting the unit on-stream, i.e., start-up, each reactor of the series is purged with a hot non-reactive, or inert gas, suitably nitrogen heated to provide an outlet temperature of about 700° F. to 800° F. The nitrogen is then cut out, and fresh or recycle hydrogen at similarly elevated temperature is added. With the hydrogen circulating through the unit at the temperature desired for conducting the reforming reaction, the naphtha is then introduced, and heated to reaction temperature to initiate the reforming reaction. Hydrogen is continuously added to the process during the reforming operation but since there is a net yield of hydrogen during reforming, recycle hydrogen is taken from a high pressure separator as a by-product, and some of the hydrogen is recycled to the lead reactor of the unit. High octane gasoline is produced and stored.

During reforming a carbonaceous or coke deposit is gradually laid down on the catalyst, and although hydrogen suppresses such deposits to some extent, a gradual increase in process temperature is required to compensate for the gradual loss of catalyst activity caused by coke deposition. Eventually, however, process economics dictate regeneration of the catalyst which requires termination of the process operation to remove the coke deposits by combustion. Other phenomena, however, are involved in activation of the catalyst, and hence the catalyst is thereafter further reactivated. After regeneration, and reactivation of the catalyst, the reactor unit must again be brought back on-stream, as with fresh catalyst. Typical start-up temperatures range from about 700° F. to about 940° F., with the process being terminated for regeneration, and reactivation of the catalyst at end-of-run temperatures ranging from about 900° F. to about 985° F.

The catalysts employed in reforming are polyfunctional, the catalyst composites including a component comprising a metal, or metals, or a compound or compounds thereof, providing a hydrogenation-dehydrogenation (hydrogen transfer) function, isomerization function, hydrocracking function, and/or hydrogenolysis function, and an acidic component providing isomerization, cracking, and/or hydrocracking functions. Platinum group metals, or Group VIII noble metals (ruthenium, osmium, rhodium, iridium, paladium and platinum), despite their expense, have been long recognized as particularly efficient hydrogen transfer components. Platinum metal per se has, in fact, proven an outstanding hydrogen transfer component and it possesses a combination of properties which makes it particularly suitable as a component for commercial reforming catalysts. Conventional reforming catalyst have thus long employed platinum composited with an inorganic oxide base, notably alumina, to which halogen is added to supply the acidic function; and platinum catalysts have achieved worldwide use in commercial reforming operations.

With the demise of alkyl-lead compounds as additives for octane improvement, additional metallic components have been added as promoters to further improve the activity and selectivity of the basic platinum catalyst, and from such efforts platinum-iridium catalysts have been produced. These catalysts possess superior activity for use in reforming operations as compared with platinum catalysts, activity being defined as that property of a catalyst which imparts the ability to produce aromatics; aromatic production (or octane improvement) generally being measured as a function of temperature, feed rate, etc. They also possess satisfactory selectivity which is defined as that property which imparts the ability of the catalyst to produce high yields of $C_5+$ liquid products with concurrent low production of normally gaseous hydrocarbons, i.e., $C_1$–$C_4$ hydrocarbons, and solid by-products such as coke which forms on the catalyst during reforming.

Albeit platinum-iridium catalysts have outstanding activity they nonetheless suffer an acute disadvantage after start-up, and during an initial period of an operating cycle. Such catalysts have thus been found to produce excessive hydrogenolysis of the feed during this period, all-too-much of the $C_5+$ liquids being converted into normally gaseous compounds, i.e., $C_1$–$C_4$ gases. This not only reduces selectivity, but the coke deposits suppress the activity of the catalyst. Such catalysts have thus been presulfided prior to start-up, or treated with hydrogen sulfide during the operating cycle in an effort to reduce hydrogenolysis, or both. U.S. Pat. No. 3,554,902 is illustrative of a process wherein a platinum-iridium catalyst is treated with sulfur during the reforming operation. Sulfur, as hydrogen sulfide, is intermittantly or continuously injected into the reaction zone and contacted with the catalyst at concentrations ranging up to 15 ppm sulfur, and water is contained in the reaction zone at concentration not exceeding 100 ppm. In accordance with such process, the fouling rate of the catalyst is suppressed, and the activity maintainance of the catalyst is extended. The process, however, falls far short of eliminating the problem of excessive hydrogenolysis, and further improved activity and selectivity for platinum-iridium catalysts is highly desirable.

It is, accordingly, an objective of the present invention to meet these needs; and specifically to provide a process which will further suppress operation of the process in the hydrogenolysis mode, and as well further improve the activity, activity maintenance and selectivity of platinum-iridium catalysts.

A more particular object is to provide a new and improved process for the pretreatment of platinum-iridium catalysts prior to start-up, the pretreatment rendering such catalysts less active in producing hydrogenolysis of the feed during actual reforming.

A further, and more specific object is to provide a pretreat, or start-up catalyst treatment wherein hydrogenolysis is suppressed.

These objects and others are achieved in accordance with the present invention characterized as a process wherein a bed of catalyst comprised of platinum and iridium is contacted and pretreated at elevated temperature in a zone, prior to the introduction and contact of the catalyst with feed, with hydrogen, water, halogen, suitably chlorine or hydrogen chloride, or both, and hydrogen sulfide. The bed of catalyst is treated with hydrogen sulfide up to, but not significantly beyond the point of breakthrough of hydrogen sulfide from the bed. Thereafter, the hydrogen, water and halogen are injected into the bed. Suitably, a hydrogen rich gas, or a stream consisting essentially of hydrogen, is contacted with the catalyst at temperatures ranging from about 600° F. to about 1100° F., preferably from about 700° F. to about 950° F., to reduce the metal components of the catalyst. Water can be separately injected or added to the hydrogen stream, and the catalyst can be prewetted with water prior to contact of the catalyst with the hydrogen, and the catalyst maintained in wetted condition throughout the start-up period. Suitably, the catalyst is equilibrated with the water, and continuously wetted throughout the pretreat period such that it contains from about 0.05 percent to about 16 percent water, preferably from about 0.1 percent to about 5.0 percent, based on the weight of the catalyst. Water is preferably added intermittently or continuously throughout the pretreat period with the gas, or gases, which are introduced during the pretreat period. It is essential that the water be added in high concentrations, suitably in concentration ranging from about 200 parts to about the saturation point of the gas, i.e., to about 10000 parts or higher, based on one million parts by volume of the gas. The halogen, suitably chlorine or hydrogen chloride, preferably hydrogen chloride, is added as a gaseous mixture to the zone in $H_2O$:HCl molar concentration ranging from about 10:1 to about 80:1, preferably from about 20:1 to about 60:1, these concentrations being suitable to maintain from about 0.6 percent to about 2 percent, preferably from about 0.8 percent to about 1.2 percent, halogen on the catalyst. Suitably, the hydrogen chloride can be added with the hydrogen, the hydrogen chloride being effective in maintaining the required chloride concentration on the catalyst. The hydrogen sulfide, or compound which can be employed to generate hydrogen sulfide in situ, is added as a component of a gaseous admixture to the zone in concentration ranging from about 0.03 weight percent sulfur to about 0.40 weight percent sulfur, preferably from about 0.07 weight percent sulfur to about 0.15 weight percent sulfur, based on the weight of the catalyst. The hydrogen sulfide and halogen gases are, like the hydrogen, added to the pretreat zone at temperatures ranging generally from about 600° F. to about 1100° F., preferably from about 700° F. to about 950° F.

In pretreatment of the catalyst the metal components of the catalyst can be first reduced with hydrogen, and thereafter treated with a gaseous admixture which contains water, halogen, and hydrogen sulfide; or, the hydrogen, water, halogen, and hydrogen sulfide can be simultaneously added. It is also feasible, after the reduction with hydrogen, to continue the addition of hydrogen while water, hydrogen chloride or chlorine, and hydrogen sulfide are simultaneously added. It is essential that water be present along with the hydrogen chloride, or chlorine, and the hydrogen sulfide. In all embodiments the hydrogen sulfide addition is continued up to but not substantially beyond the point of breakthrough of the hydrogen sulfide from the exit side of the bed, or side of the bed opposite that within which the gases are introduced.

In its preferred aspects, a bed of fresh or regenerated, reactivated catalyst is wetted with water and an admixture of hydrogen and halogen, preferably hydrogen chloride, saturated or near-saturated with water, and hydrogen sulfide is passed through the catalyst bed until the time that the bed has adsorbed, absorbed or has otherwise taken up sufficient hydrogen sulfide that it begins to appear in the exit gas. On breakthrough of the hydrogen sulfide from the exit side of the bed, the introduction of the hydrogen sulfide gas is discontinued.

In the breakthrough treatment with hydrogen sulfide, or gases which contain hydrogen sulfide, there will be an initial period when all of the hydrogen sulfide is adsorbed, absorbed, or reacted with the catalyst but eventually, a minute amount of hydrogen sulfide will appear in the exit gas. This is a typical chromatographic response commonly observed in systems wherein a gaseous component is adsorbed or desorbed on a bed of solids of high surface area. After the first appearance of hydrogen sulfide, the concentration, at first slowly, but then rapidly increases until eventually a maximum concentration is reached, at which time the concentration of hydrogen sulfide in the exit gas becomes equal to the concentration of hydrogen sulfide in the inlet gas. Pursuant to the best mode of practicing the present invention, hydrogen sulfide treatments are discontinued before that point in time when the hydrogen sulfide concentration in the exit gas becomes equal to the hydrogen sulfide concentration of the inlet gas, preferably when the concentration in the exit gas ranges from about 1 part to about 5 parts, per million parts of treat gas.

A preferred platinum-iridium catalyst composition is one which is comprised of from about 0.05 to about 3 percent platinum, preferably from about 0.1 to about 1 percent platinum, and from about 0.05 to about 3 percent iridium, preferably from about 0.1 to about 1 percent iridium, based on the total weight (dry basis) of the composition. Preferably, also, the sum total of the platinum and iridium contained in such catalyst compositions ranges from about 0.3 to about 1 percent, and more preferably from about 0.45 to about 0.70, based on the weight (dry basis) of the total catalyst compositions. In the more preferred compositions, the atom ratio of platinum:iridium ranges from about 0.25:1 to about 5:1, preferably from about 1:1 to about 2:1. The catalysts, during a reforming operation should also contain from about 0.6 to about 2 percent halogen, preferably from about 0.8 to about 1.2 percent halogen, and from about 0.001 to about 2 percent, and preferably from about 0.001 to about 0.1 percent sulfur, based on the total weight (dry basis) of the catalyst compositions.

In forming the fresh catalysts, the metals are composited with mildly or moderately acidic refractory inorganic oxides which are employed as supports, e.g., silica, silica-alumina, magnesia, thoria, boria, titania, zirconia, various spinels and the like, including, in particular, alumina, and more particularly gamma alumina, which species are preferred. High surface area catalysts, or catalysts having surface areas ranging upwardly from about 100 $M^2/g$ (B.E.T.) are preferred. In particular, catalysts having surface areas ranging from about 150 to about 600 $M^2/g$ prove quite satisfactory.

The platinum and iridium components can be composited or intimately associated with the porous inorganic oxide support or carrier by various techniques known to the art such as ion-exchange, coprecipitation with the alumina in the sol or gel form, etc. For example, the catalyst composite can be formed by adding together suitable reagents such as salts of platinum and iridium and ammonium hydroxide or ammonium carbonate, and a salt of aluminum such as aluminum chloride or aluminum sulfate to form aluminum hydroxide. The aluminum hydroxide containing the salts of platinum and iridium can then be heated, dried, formed into pellets or extruded, and then calcined in nitrogen or non-agglomerating atmosphere. The catalyst is then hydrogen treated, or hydrogen sulfide treated, or both, in situ or ex situ of a reactor, to reduce the salts and complete the formation of the catalyst composite.

It is generally preferred, however, to deposit all of the metal on the previously pilled, pelleted, beaded, extruded, or sieved particulate support material by the impregnation method. Pursuant to the impregnation method, porous refractory inorganic oxides in dry or solvated state are contacted, either alone or admixed, or otherwise incorporated with a metal or metals-containing solution, or solutions, and thereby impregnated by either the "incipient wetness" technique, or a technique embodying absorption from a dilute or concentrated solution, or solutions, with subsequent evaporation to effect total uptake of liquid. The catalyst is then dried and, if smaller particles are desired, then crushed to form particles of the desired size ranging, e.g., from about 5 to about 200 mesh (Tyler series), and preferably particles of about 1/10 to about 1/50 inch average diameter can be used. The support material can be treated by contact with a single solution containing the desired amounts of platinum and iridium, which is preferred, or treated sequentially by contact with a solution which contains one or both metals, in the desired amounts. The catalyst from any preparative sequence can then be dried, calcined in a non-agglomerating atmosphere and contacted with hydrogen, or hydrogen sulfide, or both, in situ or ex situ relative to reactor, to reduce part or all of the metal salts and activate the catalyst.

The incorporation of an acidic or isomerization component within the catalyst composite is essential. It is preferred to incorporate the acidic or isomerization function required of the catalyst by addition of halide, e.g., fluoride, chloride, and the like, particularly chloride to the catalyst composite to control the rate of isomerization and cracking. This is conveniently and preferably done during the time of incorporation of the metals onto the support, or less preferably subsequent to metals addition to the support. The metals thus can be added as halide salts of platinum and iridium during preparation of these catalysts. Generally, from about 0.6 to about 2 weight percent, and preferably from about 0.8 to about 1.2 percent, based on the weight of the total catalyst composite, of the halide is added during manufacture of the catalyst, though halogen can also be added, or replenished, during regeneration or in situ during normal reforming operations. The partially dried catalyst, after incorporation of the metals, and halogen, is then completely dried or calcined in nitrogen or other non-agglomerating medium. The freshly calcined catalyst is then treated with hydrogen and reduced, and then sulfided to activate the catalyst for subsequent use in a reforming reaction.

In catalytic reforming, as heretofore suggested, the activity of a catalyst gradually declines due to a build-up of carbonaceous, or coke deposits on the catalyst and eventually regeneration, and reactivation of the catalyst is necessary. Regeneration, and reactivation is normally conducted by swinging one reactor at a time out of series, while reforming is continued in the other reactors of the series, or by shutting down the whole reforming unit and treating all of the catalyst of the several reactors simultaneously prior to returning the reactors to onstream conditions. In either event, reactivation is accomplished in part, as is also known, by subjecting the catalyst to an oxidizing atmosphere to remove the carbonaceous deposits by burning at controlled conditions. The regeneration, or burning step can be conducted in one or more cycles. Oxygen concentration at low temperature, e.g., with flame front temperature ranging about 800°-1000° F., is sufficient to produce depletion of the coke from the catalyst. Maximum temperatures range generally no higher than about 1100° F. or 1200° F., but preferably are much less to avoid sintering of the catalyst. Higher temperatures should never be permitted for an extended period. Precise control, however, is difficult and, while incomplete removal of the coke deposits is acceptable in some cases, it is generally preferred to remove substantially all of the burnable coke from the catalyst.

Reactivation also requires redispersion of the agglomerated metals. Dispersion of the agglomerated metals is best accomplished in accordance with a series of hydrogen, chlorine treats described, e.g., in U.S. Pat. No. 3,939,061 herewith incorporated by reference, and described below.

At least two, and generally up to about five, or more, cycles of sequential hydrogen reduction and halogenation treatments are required to reactivate a coke-depleted reforming catalyst to its original state of activity, or activity approaching that of fresh catalyst after coke or carbonaceous deposits have been burned from the catalyst. Preferably, from 2 to about 3 cycles of sequential hydrogen reduction and chlorination treatment are employed, after carbon burn-off, in treating agglomerated catalysts resulting from typical reforming operations.

REDUCTION

After the coke burn-off step, oxygen is purged from the reaction zone by introduction of a nonreactive or inert gas, e.g., nitrogen, helium, or flue gas, to eliminate the hazard of a chance explosive combination of hydrogen and oxygen. A reducing gas, particularly hydrogen or a hydrogen-containing gas, generated in situ or ex situ, it first introduced into the reaction zone and contacted with the coke-depleted catalyst to effect reduction of a substantial portion of the hydrogenation-dehydrogenation components of the catalyst. Pressures are not critical, but typically range between about 5 psig to about 100 psig. Suitably, the gas employed comprises from about 0.5 to about 50 percent hydrogen, with the balance of the gas being substantially nonreactive or inert. Pure, or essentially pure, hydrogen is, of course, suitable but is quite expensive and therefore need not be used. The concentration of the hydrogen in the treating gas and the necessary duration of such treatment, and temperature of treatment, are interrelated, but generally the time of treating the catalyst with a gaseous mixture such as described ranges from about 0.1 hour to about 48 hours, and preferably from about 0.5 hours to about 24 hours, at the more preferred temperatures.

HALOGENATION

Prior to introduction of halogen, hydrogen may be purged from the reaction zone, if desired, suitably by use of a nonreactive or inert gas such as helium, nitrogen or flue gas. The halogenation step is then carried out by injecting hydrogen chloride or chlorine, or a compound which will decompose in situ to liberate hydrogen chloride or chlorine, or both, in the desired quantities, into the reaction zone and into contact with the reduced catalyst. The gas is generally introduced as hydrogen chloride, chlorine or chlorine-containing gaseous mixture, into the reforming zone and into contact with the reduced catalyst at temperature ranging from about 850° F. to about 1150° F., and preferably from about 900° F. to about 1000° F. The introduction may be continued up to the point that the hydrogen chloride or chlorine concentration in the outlet gas is substantially equal to the hydrogen chloride or chlorine concentration of the inlet gas. The concentration of hydrogen chloride or chlorine is not critical, and can range, e.g., from a few parts per million to essentially pure hydrogen chloride or chlorine gas. Suitably, the hydrogen chloride or chlorine is introduced in a gaseous mixture wherein it is contained in concentration ranging from about 0.01 mole percent to about 10 mole percent, and preferably from about 0.1 mole percent to about 3 mole percent.

The reforming reaction is conducted with the activated, or reactivated catalyst at temperatures ranging from about 600° to about 1050° F., and preferably at temperatures ranging from about 850° to about 1000° F. Pressures range generally from about 50 to about 750 psig, and preferably from about 100 to about 500 psig. The reactions are conducted in the presence of hydrogen to suppress side reactions normally leading to the formation of unsaturated carbonaceous residues, or coke, which deposits upon and causes deactivation of the catalyst. The hydrogen rate, once-through or recycle, is generally within the range of from about 1000 to about 10,000 SCF/Bbl, and preferably within the range of from about 3000 to about 8000 SCF/Bbl. The feed stream, in admixture with hydrogen, is passed over beds of the catalyst at space velocities ranging from about 0.1 to about 25 W/W/Hr., and preferably from about 0.5 to about 5.0 W/W/Hr.

Suitable feeds are comprised of essentially any hydrocarbon fractions which contain paraffins, naphthenes, and the like, admixed one with the other or in admixture with other hydrocarbons. Typical feed stream hydrocarbon molecules are those containing from about 5 to about 12 carbon atoms, or more preferably from about 6 to about 12 carbon atoms, or more preferably from about 7 to about 10 carbon atoms. Naphthas, or petroleum fractions, boiling within the range of from about 80° F. to about 450° F., and preferably from about 125° F. to about 375° F., contain hydrocarbons or carbon numbers within these ranges. Typical fractions thus usually contain from about 20 to about 80 volume percent of paraffins, both normal and branched, which fall in the range of about $C_5$ to $C_{12}$, and from about 20 to about 80 volume percent of naphthenes boiling within the range of about $C_6$ to $C_{12}$. Typical feeds generally contain from about 5 through about 50 volume percent of aromatics which boil within the range of about $C_6$ to $C_{12}$, typically as produced in the product from the naphthenes and paraffins.

The invention will be more fully understood by reference to the following selected nonlimiting examples and comparative data which illustrate its more salient features. All parts are given in terms of weight except as otherwise specified. Gas flow rates are given in terms of standard cubic feet per hour per pound of catalyst charged to the reaction zone. Where parts are given in terms of parts per million (ppm), vppm refers to the volume in parts per million and wppm refers to the weight in parts per million.

EXAMPLES

Two halogenated platinum-iridium catalysts were prepared as substantially identical as practical for demonstrative purposes from portions of particulate alumina of the type conventionally used in the manufacture of commercial reforming catalysts. The portions of alumina were impregnated with solutions of salts of platinum and iridium metals treated with chlorine, activated and each then evaluated in a continuously operated reactor for reforming naphtha at essentially the same conditions of temperature (EIT), pressure, and hydrogen rate. The space velocity of the runs was varied as required to produce 100 RONC product as identified in the tabulated data.

The compositions of the two catalysts were as follows:

Catalyst A 0.274% Pt
0.252% Ir
1.24% Cl

Catalyst B 0.295% Pt
0.293% Ir
1.25% Cl

The catalysts, after their preparation, were each evaluated in separate extended reforming tests in a small continuous flow, once-through reactor with a wide boiling range naphtha feed. The inspections on the feed are as presented in Table I, as follows:

TABLE I

| | Feed |
|---|---|
| API Gravity | 54.7 |
| Octane, RONC | 60.3 |
| Total Aromatics, Vol. % | 16.5 |
| Total Naphthenes, Vol. % | 38.6 |
| Total Paraffins, Vol. % | 44.9 |
| Sulfur, wppm | 1.2 |
| Chlorine, wppm | 1.0 |
| Water, wppm | 13 |
| Distillation (ASTM-D86) | |
| IBP, °F. | 182 |
| 5% | 218 |
| 10 | 220 |
| 20 | 231 |
| 30 | 240 |
| 40 | 250 |
| 50 | 260 |
| 60 | 271 |
| 70 | 283 |
| 80 | 296 |
| 90 | 314 |
| 95 | 333 |
| FBP, °F. | 376 |

Reforming runs, as shown by reference to Tables II and III, were conducted with each of these catalysts, 127 grams of Catalyst A and 123 grams of Catalyst B having been charged, respectively, into a reactor.

Conventional Reforming Run

In the start-up of the reactor to which Catalyst A had been charged the temperature of the reactor was elevated from ambient to 350° F., and then from 350° F. to 700° F. at a rate of 20° F./hr, while hydrogen was introduced at a rate of 55 SCF/hr. at 30 psig. The 700° F. temperature was maintained until the exit gas contained less than 200 vppm of water, then the temperature was raised to 900° F. and maintained at that temperature until the exit gas contained less than 100 vppm of water. The temperature of the reactor was then lowered to 700° F. and an admixture of gases comprised of 80.00% $N_2$, 19.96% $H_2$, and 0.04% $H_2S$ was introduced into the reactor at a rate of 35 SCF/hr., at 5 psig. This treatment was continued to $H_2S$ breakthrough which occurred about 35 minutes after the introduction of the gases. Feed was then cut into the reactor and reforming conducted at 3.5 WHSV, 5000 SCF/Bbl of $H_2$, 700° F., at 150 psig. Temperature was gradually raised from 700° F. to 900° F. while the feed rate was adjusted to maintain a 100 RONC product, with the results given in Table II.

TABL II

| Hour On Oil | WHSV For 100 RONC | $C_5$ + Yield LV % at 100 RONC |
|---|---|---|
| 200 | 2.53 | 80.8 |
| 400 | 1.73 | 80.6 |
| 600 | 1.58 | 80.5 |
| 800 | 1.52 | 80.4 |

Reforming Run of This Invention

On start-up of the reactor to which Catalyst B had been charged the temperature of the reactor was elevated from ambient to 350° F., and then from 350° F. to 750° F. while nitrogen was introducted at a rate of 8 SCF/hr at 5 psig. While the 750° F. temperature was maintained an admixture of gases comprised of 83.98% $H_2$, 15.0% $N_2$, 1.0% $H_2O$, and 0.02% HCl was introduced at 40 SCF/hr into the reactor over a period of 4 hours. This treatment was followed by the introduction of an admixture comprised of 54.935% $H_2$, 44.0% $N_2$, 1.0% $H_2O$, 0.02% HCl and 0.045% $H_2S$ also at a rate of 40 SCF/hr, and this treatment was continued to 30 minutes beyond the point of $H_2S$ breakthrough which occurred about 180 minutes after the initial introduction of the gas. About 20 SCF/hr of $H_2$ was then introduced into the reactor over a 5 minute period, and then 25 SCF/hr of catalyst of $N_2$ was introduced over a period of 10 minutes. The temperature of the catalyst was then permitted to cool to ambient. The temperature of the catalyst was then again gradually raised to 350° F., then nitrogen was introduced and the temperature then raised from 350° F. to 700° F. at a rate of 2° F./minute. Feed was then cut into the reactor and reforming conducted at 3.5 WHSV, 700° F., 5000 SCF/Bbl of $H_2$, at 150 psig. Temperature was gradually raised from 700° F. to 900° F. while the feed rate was adjusted to maintain a 100 RONC product, with the results given in Table III.

TABLE III

| Hours On Oil | WHSV For 100 RONC | $C_5$ + Yield LV % at 100 RONC |
|---|---|---|
| 200 | 3.22 | 81.4 |
| 400 | 3.35 | 80.5 |
| 600 | 3.40 | 80.5 |
| 800 | 3.40 | 80.5 |

When the results of running Catalyst A at generally optimum conditions, for conventional practice, as given in Table II are compared with those for Catalyst B at generally optimum conditions for this invention, as given in Table III, it is immediately obvious that Catalyst B is considerably more active than Catalyst A. Moreover, it is readily apparent that the activity of Catalyst B improves gradually after start-up, and is sustained over the period of the run.

It is apparent that various mmodifications and changes can be made without departing the spirit and scope of the present invention.

Having described the invention what is claimed is:

1. In a process for catalytically reforming a hydrocarbon feed boiling within the gasoline range by contacting said feed at reforming conditions with a bed of catalyst comprised of platinum, iridium and halide components composited with inorganic oxide, the improvement which comprises contacting and pretreating said catalyst at temperatures ranging from about 600° F. to about 1000° F., prior to contact of said hydrocarbon feed with said catalyst, with hydrogen, to reduce the platinum and iridium components, equilibrating and wetting said catalyst with water, and maintaining said catalyst in wetted condition throughout said pretreatment while adding an admixture comprised of water, halogen, and hydrogen sulfide, and thereafter introducing said hydrocarbon feed into contact with said catalyst at reforming conditions to initiate the catalytic reforming reaction.

2. The process of claim 1 wherein the catalyst is first contacted with hydrogen to reduce the platinum and iridium components, and thereafter with the admixture comprised of water, halogen and hydrogen sulfide.

3. The process of claim 1 wherein the catalyst is contacted in an initial step with hydrogen, and thereafter with an admixture comprised of hydrogen, water, halogen and hydrogen sulfide.

4. The process of claim 1 wherein the catalyst is contacted ab inito with an admixture of hydrogen, water, halogen and hydrogen sulfide.

5. The process of claim 1 wherein the catalyst is comprised of from about 0.05 percent to about 3 percent platinum, 0.05 percent to about 3 percent iridium, and from about 0.1 percent to about 2.5 percent halogen composited with alumina.

6. The process of claim 1 wherein the catalyst is comprised of from about 0.1 percent to about 1 percent platinum, 0.1 percent to about 1 percent iridium, and from about 0.5 percent to about 2 percent halogen composited with alumina.

7. The process of claim 1 wherein the halogen contacted with the catalyst in catalyst pretreating is hydrogen chloride or chlorine, or both.

8. The process of claim 1 wherein the catalyst pretreating is conducted at temperatures ranging from about 600° F. to about 1100° F.

9. The process of claim 8 wherein the temperature ranges from about 700° F. to about 950° F.

10. A process for catalytically reforming a hydrocarbon feed boiling within the gasoline range by contacting same at reforming conditions with a bed of reactivated catalyst comprised of platinum, iridium and halide and sulfide components composited with inorganic oxide, wherein the catalyst has been deactivated by the deposition of coke deposits thereon, which comprises contacting the bed of said catalyst with a gaseous mixture containing oxygen at an elevated temperature for time sufficient to burn coke deposits therefrom, contacting said coke-depleted catalyst with hydrogen for a time sufficient to reduce said platinum and iridium components of said catalyst, contacting said reduced catalyst with an oxygen-free halogen-containing gas at temperatures sufficient to halogenate the catalyst equilibrating and wetting said coke-depleted catalyst with water, maintaining said catalyst in wetted condition and pretreating same at temperatures ranging from about 600° F. to about 1000° F. while adding an admixture comprised of water, halogen and hydrogen sulfide, and thereafter introducing said hydrocarbon feed into contact with said catalyst at reforming conditions to initiate the catalytic reforming reaction.

11. The process of claim 10 wherein the coke-depleted catalyst is first contacted with hydrogen to reduce the platinum and iridium components, and thereafter with the admixture comprised of water, halogen and hydrogen sulfide.

12. The process of claim 10 wherein the coke-depleted catalyst is contacted in an initial step with hydrogen, and thereafter with an admixture of hydrogen, water, halogen and hydrogen sulfide.

13. The process of claim 10 wherein the coke-depleted catalyst is contacted ab initio with an admixture of hydrogen, water, halogen and hydrogen sulfide.

14. The process of claim 10 wherein the catalyst is comprised of from about 0.05 percent to about 3 percent platinum, 0.05 percent to about 3 percent iridium, and from about 0.1 percent to about 2.5 percent halogen composited with alumina.

15. The process of claim 10 wherein the catalyst is comprised of from about 0.1 percent to about 1 percent platinum, 0.1 percent to about 1 percent iridium, and from about 0.5 percent to about 2 percent halogen composited with alumina.

16. The process of claim 10 wherein the halogen contacted with the catalyst in catalyst pretreating is hydrogen chloride or chlorine, or both.

17. The process of claim 10 wherein the catalyst pretreating is conducted at temperatures ranging from about 600° F. to about 1100° F.

18. The process of claim 17 wherein the temperature ranges from about 700° F. to about 950° F.

* * * * *